United States Patent [19]

Shima et al.

[11] Patent Number: 4,470,274

[45] Date of Patent: Sep. 11, 1984

[54] FLAT KNITTING MACHINE

[75] Inventors: Masahiro Shima; Hirozi Nishida, both of Wakayama, Japan

[73] Assignee: Shima Idea Center Co., Ltd., Wakayama, Japan

[21] Appl. No.: 487,002

[22] Filed: Apr. 21, 1983

[30] Foreign Application Priority Data

Apr. 28, 1982 [JP] Japan ..... 57-72254

[51] Int. Cl.[3] ..... D04B 7/00

[52] U.S. Cl. ..... 66/75.1; 66/78

[58] Field of Search ..... 66/64, 78, 76, 70, 75.1

[56] References Cited

U.S. PATENT DOCUMENTS 4,012,927 3/1977 Kunert ..... 66/78

4,287,727 9/1981 Otoshi ..... 66/75.2

4,413,482 11/1983 Steiger ..... 66/78

*Primary Examiner*—Ronald Feldbaum

[57] ABSTRACT

In a flat knitting machine wherein needles or jacks connected thereto, each has two butts, front and rear and wherein there is provided a space below a center cam and between a pair of raising cams in a knitting lock, there is disposed in the space a loop-receiving raising cam having a cam face adapted to act on the rear butt to raise the needle to a loop receiving path and also present therein a loop-receiving lowering cam face formed of a bottom portion of the center cam and adapted to lower the needle to the loop receiving path. Preferably, a retractable guide cam is located above the center cam and there is disposed above the guide cam a loop-transfer lowering cam having a cam face adapted to act on the rear butt to lower the needle. Further, above this loop transfer lowering cam is there retractably disposed a loop-transfer raising cam which has a cam face adapted to act on the front butt to raise the needle. In this way there are disposed a knitting lock and a transfer lock at same phase in the direction of movement of the carriage, without involving any increase in the length of cam box in that direction and also in the longitudinal direction of the needle. No increase is involved in the length of needle trick either.

24 Claims, 11 Drawing Figures

FLAT KNITTING MACHINE

BACKGROUND OF THE INVENTION

The present invention relates to a flat knitting machine wherein there is disposed a transfer lock which permits needles to be selectively guided into a loop transfer path or a loop receiving path, in same phase as a knitting lock which permits needles to be selectively guided to three positions, knit, tucking, and welt, so that needles are allowed to knit, tuck, welt or transfer within an operative zone in same phase as the knitting lock in the widthwise direction of a carriage.

A prior art disclosure relevant to such type of machine is found in Published UK Patent Application GB No. 2080344A, which discloses a cam support comprising at least one arrangement of lifting cams comprising two lifting cams arranged immediately one after the other and each comprising two opposed ramps and a third lifting cam disposed between the adjacent ramps of the two first cams, an empty space being provided below the third cam, said space being connected to two channels limited on one side by the adjacent ramps of the two first cams, so that a pin, respectively of a needle, selected before the arrival of an outer end of said first cams, is entrained by one of the said first cams, in the direction of movement of the cam-support and by the third cam and operates for shaping, whereas a pin, respectively of a needle, selected when said empty space arrives approximately opposite said pin, respectively of a needle, is not entrained by the third cam and operates for picking up.

In this prior-art system, however, the cam for pushing a front butt (which is disposed on a needle, while a rear butt is disposed on a pin or jack) to put the needle into a path of transferring operation is movable, and its upper surface constitutes a cam face which will act on the back of the front butt to lift the needle to the transferring path, whereas its underside constitutes a cam face for pushing the front of the front butt to lower the needle into a stitch receiving path. And for the purpose of lowering the needle from the transferring path, there is disposed above said movable cam a guide cam which is fixed. This guide cam acts on the front of the front butt to lower the needle.

Therefore, to the extent that such fixed guide cam for pushing the abutment surface of the front butt to lower the needle from the transfer path is disposed above said movable cam for putting the needle into the transfer path, the prior-art cam system involves larger lengths of cam plate and needle bed in the longitudinal direction of the needle trick, and also an increase in the length of needle tricks.

SUMMARY OF THE INVENTION

In view of such disadvantage of the prior art, the present invention has as its primary object the provision of a flat knitting machine which has a knitting lock and a transfer lock disposed in same phase in the widthwise direction of the carriage, with the length of the needle tricks and that of the cam plate therealong as limited to the minimum possible.

More specifically, the present invention essentially consists in a flat knitting machine comprising a pair of needle beds, each having a plurality of needle tricks arranged therein, needles respectively located in the needle tricks, each needle having two butts, front and rear, disposed in longitudinally spaced apart relation thereon and/or on a jack connected to the needle, one or more knitting locks disposed on a cam plate of a cam fox on a carriage and adapted to act on the rear butt, each knitting lock including a pair of stitch cams, a pair of raising cams, and a center cam, and a space provided between said pair of raising cams and below the center cam and adapted to permit the passage of the rear butt therethrough, characterized in that there is disposed in said space a loop-receiving raising cam having at least one cam face adapted to act on the back of said rear butt to raise the needle into a loop receiving path; in that a part of the underside of said center cam that faces said space is adapted to serve as a cam face which will act on the front of said rear butt to lower the needle into the loop receiving path; in that there is disposed above the center cam a loop-transfer lowering cam having at least one cam face adapted to act on the front face of said rear butt to lower the needle into an operative zone of the stitch cams; in that above the loop-transfer lowering cam there is disposed a retractable loop-transfer raising cam having at least one cam face adapted to act on the back of said front butt to raise the needle into the loop transfer path, and in that either the rear butt or each raising cam is displaceable to an inoperative zone relative to the other so as to permit the rear butt to be guided into an operative zone of said loop-receiving raising cam in said space.

The above and other related objects and features of the invention will be apparent from the following description and claims taken in connection with the accompanying drawings, forming a part of this application.

DESCRIPTION OF THE DRAWINGS

FIGS. 1 to 4, inclusive, present one embodiment of this invention, in which FIG. 1 is a longitudinal section of a needle bed showing a needle in its retreated position; FIG. 2 is a longitudinal sectional view of a needle bed showing the needle in its advanced position; FIG. 3 is a plan view showing one cam arrangement by way of example; and FIG. 4 is a plan view showing a pair of cam arrangements, front and rear;

FIGS. 5 to 7, inclusive, show another embodiment of the invention, in which FIG. 5 is a longitudinal section of a needle bed showing a needle in its advanced position; FIG. 6 is a plan view showing one cam arrangement; and FIG. 7 is a plan view showing a pair of cam arrangements, front and rear;

DESCRIPTION OF THE PREFERRED EMBODIMENTS

Figure 1:
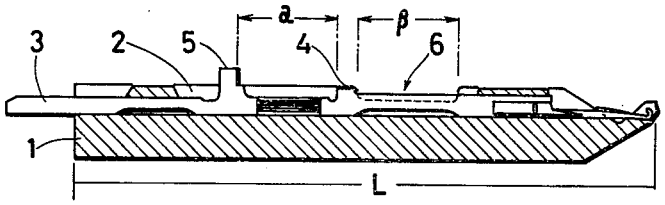
Figure 2:
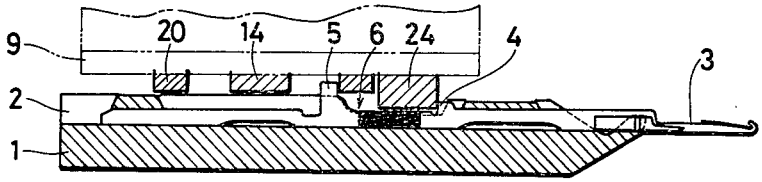

Referring first to the embodiment shown in FIGS. 1 to 4, inclusive, the V-bed flat knitting machine has a pair of needle beds 1,1, each having a plurality of needle tricks 2 in which there are individually disposed needles 3 having no jack. On the face of a needle 3 having transfer function in each needle trick 2 there are disposed two butts 4, 5, front and rear, at two locations (needle point side is understood to be front side) with a distance $\alpha$ therebetween. In the present embodiment, the front butt 4 is substantially lower in height than the rear butt 5. More specifically, the height of the front butt 4 is set so low that a loop-transfer raising cam 24 to be hereinafter described can act thereon only when it is in a U-shaped section groove 6 having a prescribed width $\beta$ and that a knitting lock 10 to be described below cannot act thereon.

Figure 3:
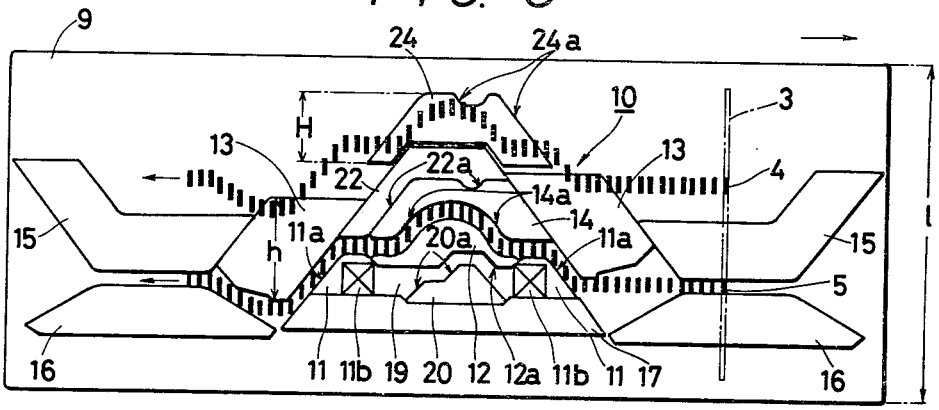
Figure 4:
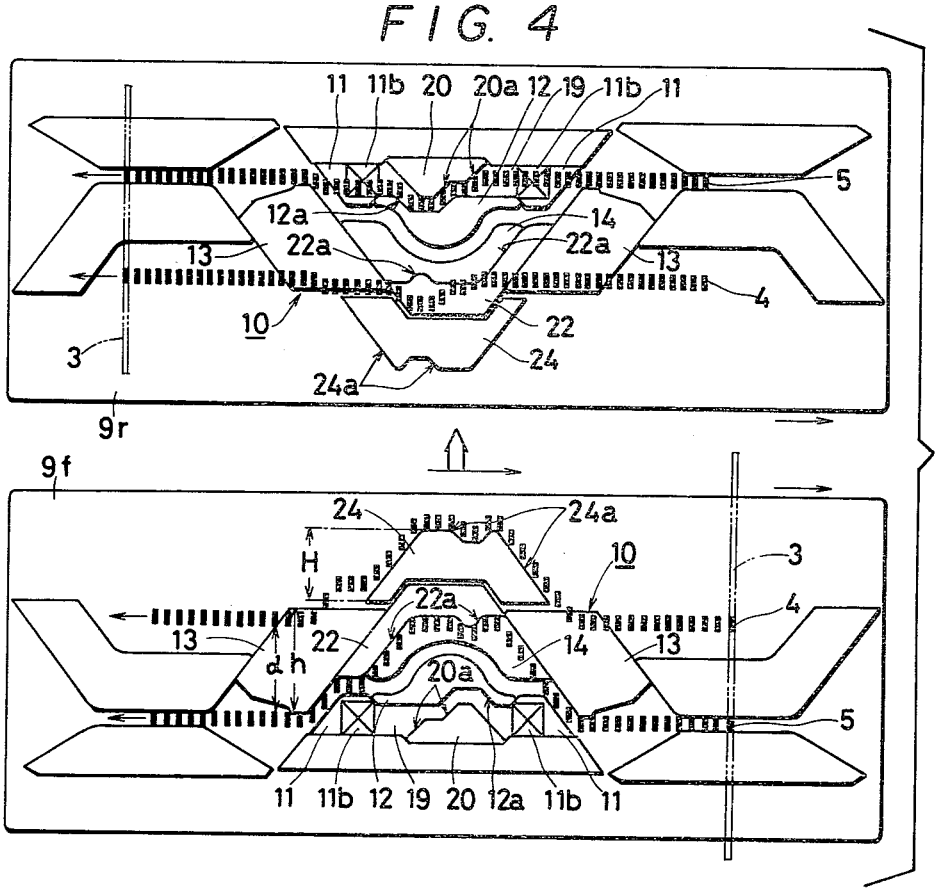

In order to selectively cause such needles to knit, tuck, welt or transfer, there are arranged cam mechanisms on a cam plate 9. Referring to FIGS. 3 and 4, the knitting lock 10 in the embodiment comprises a pair of raising cams 11,11 retractably mounted on the cam plate 9, a center cam 12 which is also retractable, a pair of stitch cams 13,13 obliquely up and down slidable, and a guide cam 14 disposed between said pair of stitch cams 13,13 and above the center cam 12 (the upper side in FIG. 3 is understood to be the higher-level side herein). The guide cam 14 has a pair of cam faces 14*a*, 14*a* adapted to act on the rear butt 5 to lower the needle 3 into an operative zone of the stitch cams and is retractable into the cam plate 9.

On both sides of and below the knitting lock 10 there are fixedly mounted guide cams 15,15,16,16,17, each being adapted to act on the rear butt 5 to guide the needle 3 into an operative zone of the knitting lock 10. Between said pair of raising cams 11,11 and below the center cam 12 there is provided a space 19 which permits formation of a welting path for the rear butt 5 and a loop receiving path for transferring. In this space 19 there is disposed a loop-receiving raising cam 20 having a cam face 20*a* adapted to act on the back of the rear butt 5 in the welting path to raise the needle 3 to the loop receiving path, said cam 20 being projectable from and retractable into the cam plate 9. Also present in said space 19 is a cam face 12*a* adapted to act on the butt 5 to lower the needle 3 to the loop receiving path, said cam face being constituted of an underside portion 12*a* of the center cam 12 that faces said space 19. In the present embodiment, the raising cams 11,11 each has a ram 11*b* (marked X) sloping down toward the space 19, on the opposite side of its raising cam face.

In the present instance, as already mentioned, there is provided, between the pair of stitch cams 13, 13 and above the center cam 12, a retractable guide cam 14 adapted to act on the rear butt 5 to guide the needle 3 to the operating zone of the stitch cams 13, 13. Above this guide cam 14 and between the pair of stitch cams 13,13 there is disposed a loop-transfer lowering cam 22 having at least one cam face 22*a* which is adapted to act on the rear butt 5 to lower the needle 3 into the operative zone of the stitch cams 13, 13 when transfer is required, if said guide cam 14 is controlled to its retracted position, said cam 22 being fixed to the cam plate 9. The amount of projection of this cam 22 from the cam plate 9, when it is in its projected position, is same as that of the knitting lock 10.

Above the loop-transfer lowering cam 22 there is disposed a loop-transfer raising cam 24 having at least one cam face 24*a* adapted to act on the back of the front butt 4 to raise the needle 3 into a loop transfer path when transfer is required, said cam 24 being projectable from and retractable into the cam plate 9 and located so that it does not interfere with the stitch-size adjusting action of stitch cam 13. Needless to say, the amount of projection and retraction of the cam 24 suffices if it is controllable between its operative and inoperative positions relative to the front butt 4 as located in said U-shaped section groove 6. In the present instance, the loop-transfer raising cam 24 is disposed on the cam plate so that it is positioned in said groove 6 when it is projected (see FIG. 2), its bottom being at a level higher than the top of cam face 22*a* of the loop-transfer lowering cam 22. In other words, the butt 4 is of such height that it never contacts the knitting lock 10 and/or the loop-transfer lowering cam 22, and said loop-transfer raising cam 24 is designed so that in its projected position it can act on the front butt 4 only and does not contact the rear butt 5.

Constructed as above described, the flat knitting machine of this embodiment is such that during the rightward movement of the carriage, that is, when the cam plate 9 is moved toward the right in FIG. 3, if raising cam 11, center cam 12, and guide cam 14 are all controlled to their respective projected positions and if the loop-transfer raising cam 24 is controlled to its retracted position, needles 3 operate for knitting since their respective rear butts path through a knitting path constituted of the raising cam 11, center cam 12, guide cam 14, and stitch cam 13, as illustrated in FIG. 3.

During this carriage movement, a portion of the knitting lock 10 and the loop-transfer raising cam 24 pass a spot overlapping the front butt 4 of each needle 3, but they do not contact the front butt 4, since the latter, as already mentioned, is so low in height that it does not extend above the U-shaped groove 6 and since the loop-transfer raising cam 24 is controlled to its retracted position.

As can be understood from the above, during any stroke of the carriage, if the raising cams 11,11 are controlled to its projected position and the center cam 12 and loop-transfer raising cam 24 to their respective retracted positions, needles 3 operate for tucking (not shown) because their respective rear butts 5 are not raised by raising cam 11 beyond their tucking position, whereas if the raising cams 11,11, center cam 12, and loop-receiving raising cam 20 are all controlled to their retracted position, the needles 3 remain in their welt position (not shown) because their rear butts 4 are not raised by any of said cams 11,12,20.

In these cases, too, a portion of the knitting lock 10 and the loop-transfer raising cam 24 pass a spot that overlaps the front butt 4 of each needle 3, but for same reasons as laredy mentioned they do not contact the front butt 4.

In operation, the cam arrangement of the present embodiment is such that during the rightward movement of the carriage, that is, movement of cam plates 9*f*, 9*r* (there is a pair of cam plates, front and rear) in the right direction in FIG. 4, if the raising cams 11,11 and loop-transfer raising cam 24 or at least one of the cam plates, e.g., front cam plate 9*f*, are controlled to their respective projected positions, and the guide cam 14 thereon to its retracted position, and if at least the preceding side (right side in FIG. 4) raising cam 11, and loop-transfer raising cam 24 on the rear cam plate 9*r* are controlled to their respective retracted positions, and the loop-receiving raising cam 20 and center cam 12 on said cam plate 9*r* to their respective projected positions, as illustrated in FIG. 4, needles 3 on the front needle bed 1 will have their respective rear butts 5 raised by raising cam 11 at its projected position so that their front butts 4 are raised to the operative zone of the loop-transfer raising cam 24, being then entrained along the loop transfer path by the raising cam face 24*a* of the loop-transfer raising cam 24 acting on the front butts 4, by the lowering cam face 22*a* of the loop-transfer lowering cam 22 acting on the rear butts 5, and by stitch cam 13, whereas needles 3 on the rear needle bed 1 will have their respective rear butts 5 guided into the space 19 by raising cam 11 at its retracted position, the rear butts 5 being then entrained along the loop receiving path by the raising cam face 20*a* of the loop-receiving raising cam 20 at its projected position and by the lowering cam face 12*a* of the center cam 12. Thus, loops engaging the needles 3 on the front needle bed 1 are transferred to the needles 3 on the rear needle bed 1.

During the leftward movement of the carriage, if the various cam means on the front and rear cam plates 9*f*,9*r* are controlled vice versa, loops engaging the needles 3 on the rear needle bed 1 can likewise be transferred to the needles 3 on the front needle bed 1. In either of the above described cases, for same reason as earlier mentioned, the knitting lock 10 does not contact the front butt 4, even if the former overlaps the latter. Hence, where the front butt 4 is of such height that the knitting lock 10 is not allowed to act thereon, as in the present embodiment, it is possible to reduce the length of the needle 3 by designing the distance $\alpha$ between the front butt 4 and the rear butt 5 to be smaller than the height of the stitch cam 13 in the lengthwise direction of the needle 3. By so doing is it also possible to reduce the height H of the loop-transfer raising cam 24 along the length of the needle 3. Thus, the length 1 of the cam plate 9 and the length L of the needle bed 1, both as seen in the longitudinal direction of the needle 3, can be reduced accordingly. It follows that the needle bed and cam box can be made more compact.

These advantages are available where, as in the present embodiment, such a diference in height is set between the front and rear butts 4,5 so that the knitting lock 10 and the loop-transfer lowering cam 22 may not contact the front butt 4, even if they overlap the front butt 4. However, the flat knitting machine of the invention is not limited by the above described embodiment in which such difference in height is provided. In another embodiment, the front and rear butts 4,5 may be designed to be of same height. In that case, the distance $\alpha$ between them may be slightly larger than that in the above embodiment so that the knitting lock 10 and the loop-transfer lowing cam 22 may not overlap the front butt 4 during the movement of the carriage.

Figure 5:
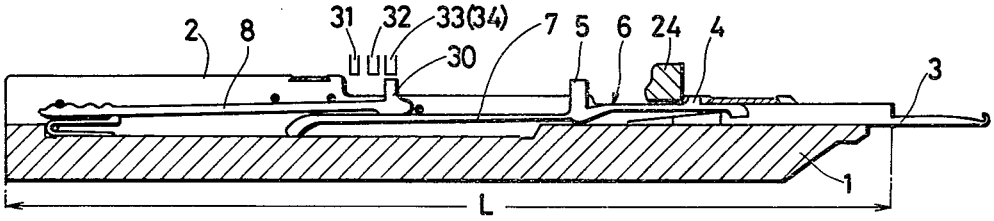

In the first preferred embodiment thus far described, both the front butt 4 and the rear butt 5 are disposed on the needle 3. In another embodiment not shown, the front butt 4 may be disposed on the needle 3 and the rear butt 5 may be disposed on a jack 7 connected to the needle 3. In a further modified form, as FIG. 5 illustrates, both the front butt 4 and the rear butt 5 may be disposed on a jack 7 connected to the needle 3.

Figure 6:
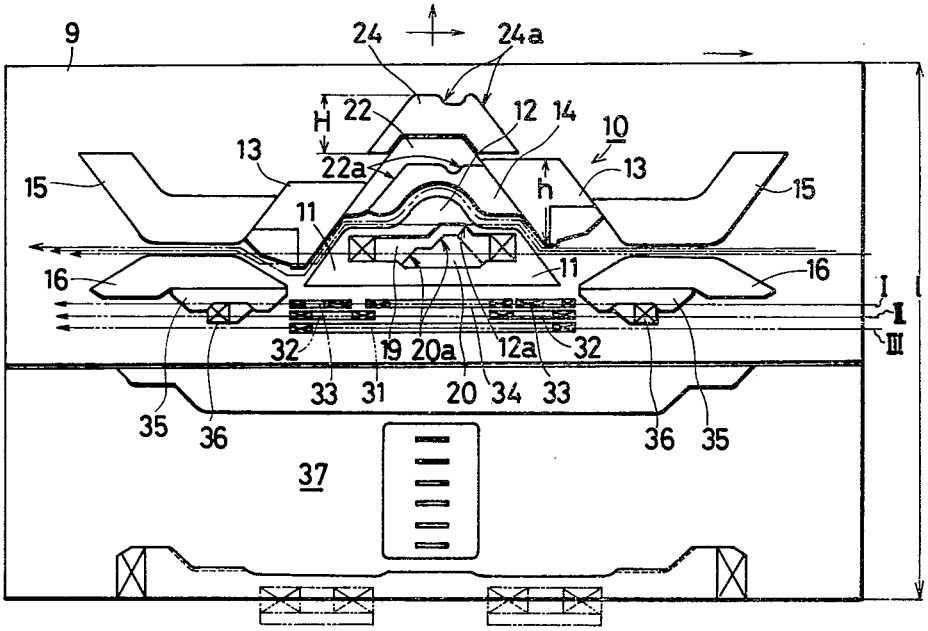
Figure 7:
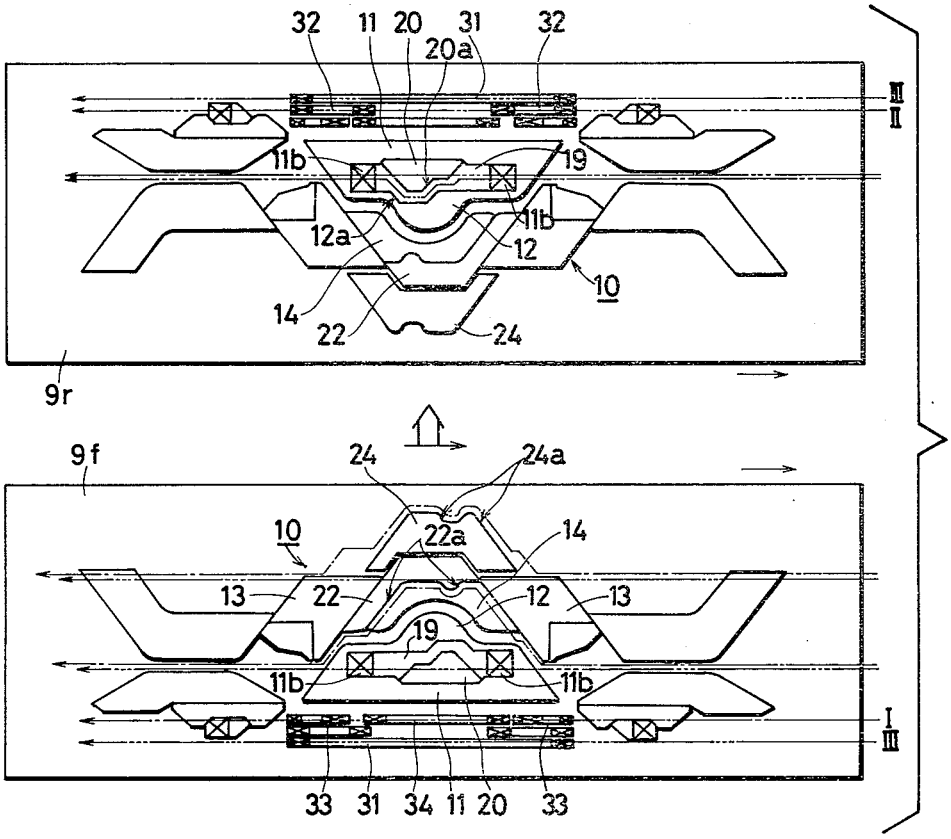

Further, in the first embodiment, the raising cams 11,11 are retractably disposed on the cam plate 9, and the center cam 12 is also retractably disposed on the cam plate 9, separately from the raising cams 11, 11. In another embodiment these cams 11,11,12 may be in the form of stationary cams integrally fixed to the cam plate 9, as illustrated in FIGS. 6 and 7. Likewise, the loop-receiving raising cam 20 is shown as projectable from and retractable into the cam plate 9 in the first embodiment; but in another embodiment as shown in FIGS. 6 and 7, the loop-receiving raising cam 20 need not be retractable and it may be fixed to the cam plate 9.

It is noted, however, that if the raising cams 11, 11, center cam 12, and loop-receiving raising cam 20 are stationary cams fixed to the cam plate 9 as above said (see FIGS. 5 to 7), there must be some suitable means for keeping the rear butt 5 of the needle 3 inoperative relative to the raising cams 11, center cam 12, and loop-receiving raising cam 20 in the operative zones of these cams 11,12,20.

Means for such purpose are disclosed in U.S. Pat. No. 4,214,460, which may be suitably employed in the above connection.

Referring to FIG. 5, in which such means are shown as incorporated, jack 7 is of flexible construction and rear butt 5 is retractable into the needle trick 2. On the jack 7 there is disposed a presser jack 8 adapted to be selectively displaceable to three positions, Advanced Position (I), Intermediate Position (II), and Retreated Position (III), by selector means provided on the carriage, for example. Whilst, on the cam plate 9 there are provided retractable presser cams 31,32,32,33,33,34. If these presser cams are selectively controlled for projection or retraction, then presser jacks 8 at said three positions I, II, III are selectively pressed on their butts 30 so that the rear butts 5 of the selected needles 3 are caused to sink into the needle tricks 2. Thus, rear butts 5 can be selectively controlled to their inoperative position within the operative zone of the raising cams 11, center cam 12, and/or loop-receiving raising cam 20. In FIG. 6, it is noted, numerals 35 and 36 are a half-clear cam and a clear cam, both retractable, which will act on the front of butt 30 of the presser jack 8, and numeral 37 is a portion of said three-position selector means for presser jacks 8.

Where such arrangement is employed, that is, rear butt 5 is disposed on a flexible jack 7 so that it may be caused to sink into the needle groove 2 if depressed by a presser jack 8, and raising cams 11,11 and center cam 12 are integrally fixed cams and loop-receiving raising cam 20 is either fixed or retractable (FIGS. 5 to 7), knitting and transferring operation is performed in the following manner (see FIGS. 6 and 7). As can be seen from FIG. 6, if presser jacks 8 are set at the retreated position III and if presser cam 31 is controlled to its projected position, rear butts 5 are kept in their lowered position in the operative zones of the raising cams 11,11 and center cam 12, and accordingly needles 3 welt (as shown by alternate long and three short dash line in FIG. 6). If presser jacks 8 are set at the intermediate position II, with presser cams 32,32 controlled to their retracted position, rear butts 5 are kept in their elevated position in the operative zones of the raising cams 11, 11 and center cam 12, and accordingly needles 3 operate for knitting (as shown by alternate long and two short dash line in FIG. 6). If presser jacks 8 are set at the advanced position I, with presser cams 33,33 controlled to their retracted position and presser cam 34 to its projected position, rear butts 5 are kept in their elevated position in the operative zone of the raising cams 11,11 and in their lowered position in the operative zone of the center cam 12, and accordingly needles 3 operate for tucking (as shown by alternate long and short dash line in FIG. 6). Now, as FIG. 7 illustrates, during the rightward travel of the carriage, that is, movement of the cam plates 9*f*,9*r* (front and rear) in the right direction in FIG. 7, if presser jacks 8 on the front needle bed 1 are set in the advanced position I, and if presser cams 33,34, 33 and guide cam 14 on the front cam plate 9*f* are controlled to their respective retracted positions, with loop-transfer raising cam 24 controlled to its projected position, needles 3 in the needle tricks 2 associated with the presser jacks 8 selected to the advanced position I are guided into the loop transfer path (shown by alternate long and short dash line in FIG. 7) by the action of those cams which act on the rear butt 5 of the jack 7 connected to each respective needle, i.e., raising cam 11, lowering cam face 22*a* of loop-transfer lowering cam 22, and stitch cam 13, and by the action of the raising cam face 24*a* of the loop-transfer raising cam 24, which act on the front butt of the needle 3. Whilst, if presser jacks 8 on the rear needle bed 1 are set at the intermediate position II, and if presser cams 32,32 on the rear cam plate 9*r* are controlled to their projected position, with loop-transfer raising cam 24 controlled to its retracted position, and loop-receiving raising cam 20 to its projected position, if it is retractable, needles 3 in the needle tricks 2 associated with the presser jacks 8 selected to the intermediate position II are guided into the loop receiving path (shown by alternate long and two short dash line in FIG. 7) by the action of those cams which act on the rear butt 5 of the jack 7 connected to each respective needle 3, i.e., raising cam face 20*a* of loop-receiving raising cam 20 and lowering cam face 12*a* of center cam 12. Thus, as is the case with the first embodiment (FIG. 4), loops engaging the needles 3 on the front needle bed 1 are transferred to the needles 3 on the rear needle bed 1.

Needless to say, in the case of this embodiment, too, when the movement of the carriage is reversed, loops can be transferred from the needles 3 on the rear needle bed 1 to those on the front needle bed 1 by a similar control procedure adjusted accordingly. As is the case with the first described embodiment, it is true with this embodiment that by setting the height of the front butt 4 at such a height as is free from the action of the knitting lock 10 it is possible to reduce the length 1 of the cam plate 9 and the length L of the needle bed 1 in the longitudinal direction of the needle 3, thus obtaining a flat knitting machine having needle beds and cam boxes of compact design.

Where the machine is equipped with needle selector means as in this embodiment (in FIGS. 5 and 7), if any presser jacks 8 on the front and/or rear needle beds 1 are set in the retreated position III and if presser cam 31 is controlled to its projected position, needles 3 in the needle tricks 2 associated with the presser jacks 8 selected to the retreated position III are caused to welt (as shown by alternate long and three short dash line in FIG. 7) because the butts 5 of the jacks 7 respectively connected to the needles 3 are kept in their lowered position, and accordingly, only other needles 3 are selectively operated for transferring (as shown by alternate long and two short dash and alternate long and short dash lines in FIG. 7).

Figure 8:
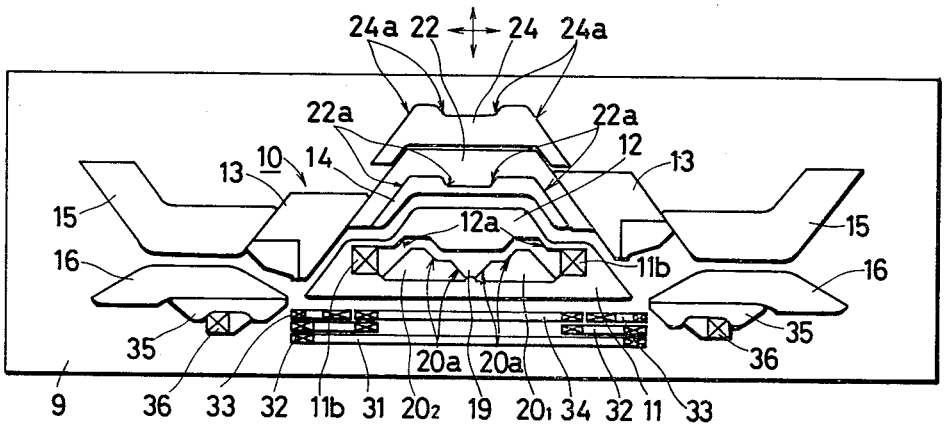
FIGS. 8 to 10, inclusive, are plan views showing further embodiments.
Figure 9:
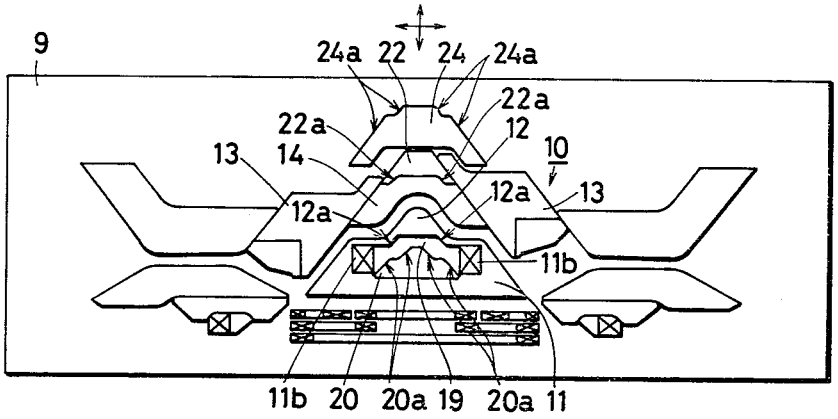

In the foregoing embodiments, the loop-receiving raising cam 20 has a cam face 20*a* adapted to act on the back of the rear butt 5 to raise the needle 3 into the loop-receiving path, only on the side facing one direction of movement of the carriage (the left direction in FIGS. 3 and 6), and the cam face 12*a* formed of said underside portion of the center cam 12 that faces said space 19 and adapted to act on the front of the rear butt 5 to lower the needles 3 into the loop receiving path is so formed as to face said one direction of movement of the carriage, whereas the loop-transfer lowering cam 22 has a cam face 22*a* adapted to act on the front of the rear butt 5 to lower the needle 3 into the operative zone of the stitch cams 11, only on the side facing the other direction of movement of the carriage (the right direction in FIGS. 3 and 6), and the loop-transfer raising cam 24 has a cam face 24*a* adapted to act on the back of the front butt 4 to raise the needle 3 into the loop transfer path, only on the side facing said other direction of movement of the carriage. In other words, these embodiments are such that knitting, tucking, and welting operations can be selectively performed during the movement of the carriage, whether in the right direction or the left, whereas during the movement of the carriage in one direction, right or left, transferring can be performed only in such a way that loops are transferred from individual needles 3 on one of the needle beds 1, front or rear, to the corresponding needles 3 on the other needle bed 1, it being impossible to transfer loops from the needles 3 on said other needle bed 1 to the corresponding needles 3 on said one needle bed 1 without reversing the direction of movement of the carriage. In another embodiment, as illustrated in FIG. 8, there is provided in said space 19 a loop-receiving raising cam $20_1$ having a cam face 20*a* adapted to act on the back of the rear butt 5 to raise the needle 3 to the loop receiving path and fronting one direction of movement of the carriage (left direction), in pair with another loop-transfer raising cam $20_2$ having a similar raising cam face fronting the other direction of movement of the carriage, or as FIG. 9 shows, the loop-receiving raising cam 20 disposed in said space 19 has a pair of cam faces 20*a*,20*a* adapted to act on the back of the rear butt 5 to raise the needle 3 to the loop receiving path and fronting both directions of movement of the carriage respectively. Concurrently, the underside of the center cam 12 that faces said space 19 has a pair of cam faces 12*a*, 12*a* formed thereon, both being adapted to act on the front of the rear butt 5 to lower the needle 3 to the loop receiving path and fronting both directions of movement of the carriage respectively; the loop-transfer lowering cam 22 has a pair of cams faces 22*a*,22*a* adapted to act on the front of the rear butt 5 to lower the needle 3 to the operative zone of the stitch cams 13 and fronting both directions of movement of the carriage respectively; and the loop-transfer raising cam 24 has a pair of cam faces 24*a*, 24*a* adapted to act on the back of the front butt 4 to raise the needle 3 to the loop transfer path and fronting both directions of movement of the carriage respectively. This arrangement permits transfer of loops from the needles 3 on one needle bed 1 to the corresponding needles 3 on the other needle bed 1 and vice versa during the movement of the carriage, whether in the right direction or in the left direction. This arrangement can have a similar functional effect.

Figure 11:
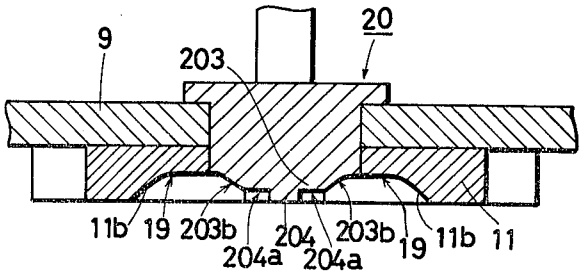
FIG. 11 is a section taken along the line XI—XI in FIG. 10.
Figure 10:
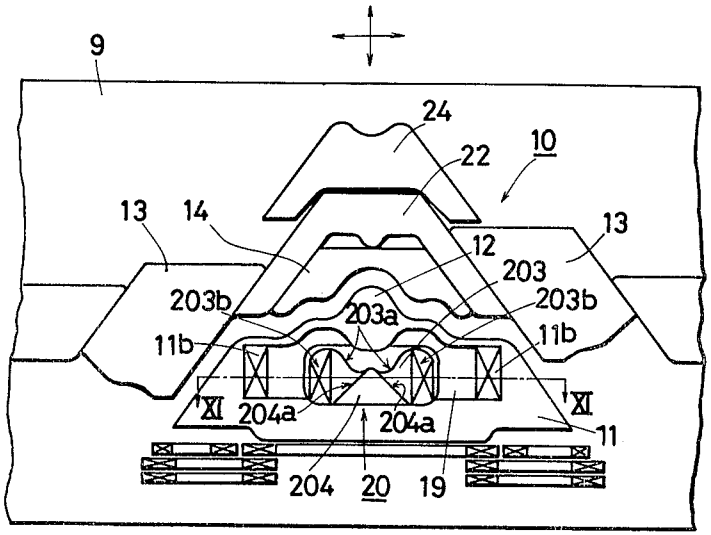

In still another embodiment, there is provided in said space 19 a loop-receiving raising cam 20 of the type illustrated in FIGS. 10 and 11. As is the case with the loop receiving cam shown in FIGS. 8 and 9, this arrangement permits transfer of loops from either side of the needle beds 1 during the movement of the carriage, whether in the right direction or in the left direction. The loop-receiving raising cam 20 in this embodiment is projectable from and retractable into the cam plate 9 and comprises a base cam 203 having a relatively low degree of projection in the direction of cam projection and a triangular cam 204 projecting from the center of the base cam 203. Said base cam 203 has ramps 203*b*,203*b* on both sides thereof, which ramps are sloped down toward the space 19. A combination of these ramps or cam faces 203*b*,203*b* and cam faces 204*a*, 204*a* formed of both side ramps of the triangular cam 204 can act on the back of the rear butt 5 in whichever direction, right or left, to guide the needle 3 into the loop receiving path. In other words, the loop-receiving raising cam 20 in this embodiment is such that when the rear butt 5 is guided into the space 19 in the raising cam 11, one of the ramps 203*b* of the base cam 203 acts on the top of the rear butt 5 to guide it to the operative zone of the triangular cam 204, which in turn acts on the back of the rear butt 5 through its cam face 204*a* to raise it a certain amount. Upon reaching the apex of the triangular cam 204, the rear butt 5 is introduced into the space 19 between the pair of cam faces 203*a*, 203*a*, and then it is advanced a certain amount by cam face 203*a* which acts on the back of the rear butt 5.

In the above described embodiments, the knitting lock 10 has, between the center cam thereof and the loop-transfer lowering cam 22 disposed thereabove, a retractable guide cam 14 having a cam face adapted to act on the front of the rear butt 5 to lower the needle 3 into the operative zone of the stitch cams. In some other embodiment, said guide cam 14 may be omitted.

Now, referring to the embodiments illustrated in FIGS. 8 to 11, inclusive, in which said raising cams 11,11 and a cam corresponding to the center cam 12 are constructed as an integral fixed cam, and in which arrangements are made to permit transfer of stitches from needles on either one of the needle beds 1 during the movement of the carriage, regardless of the direciton of such movement, further details will be described by way of supplement. In the embodiment illustrated in FIG. 8, the loop-receiving raising cams $20_1$,$20_2$ in pair are individually projectable from and retractable into the cam plate 9 so that needles 3 may be guided into the loop-receiving path during the movement of the carriage in either direction, by controlling one of the cams $20_1$,$20_2$ to the projected position and the other to the retracted position. In the case of the embodiment shown in FIGS. 9 and 10, wherein the loop-receiving raising cam 20 has raising cam faces fronting the right and left directions respectively, the loop-receiving raising cam 20 may be either retractable or fixed.

The flat knitting machine in accordance with the invention has now been described with reference to several embodiments. As can be readily understood from the above description, the flat knitting machine comprises two butts, front and rear, provided in spaced apart relation on the needle disposed in each needle trick or on the jack connected to the needle, and various cam means adapted to act on the butts and arranged in same phase in the direction of movement of the carriage so that needles can be selectively guided into the knitting, tucking, or welting tracks, or loop transfer or loop receiving track for transferring. The cam arrangement in the flat knitting machine of the invention includes one or more knitting locks which act on the rear butt, and various cam faces for transferring, including one formed on the underside of the center cam that faces a space provided below the center cam and between the right and left raising cams, said cam face being adapted to act on the front of the rear butt to guide the needle into the loop receiving path. As such, the front of the front butt need not be subjected to action of cam means for guiding the needle to the loop receiving path as is required with the prior art cam system. According to this invention, therefore, the cam arrangement is such that every needle raised into the loop transfer path may be lowered into the loop transfer path by a lowering cam face which acts on the front of rear butt of the needle on said transfer path. In other words, a loop-transfer lowering cam having a cam face for lowering a needle is disposed below a loop-transfer raising cam having a cam face adapted to act on the back of the front butt to raise the needle into the loop transfer path and in face-to-face relation to the rear butt. With the flat knitting machine according to the invention, therefore, it is not necessary to provide above the loop-transfer raising cam a guide cam having a cam face adapted to act on the front of the front butt to lower the needle, and an extension to the cam plate for locating such guide cam; and to the extent that such guide cam is not required the cam box and needle beds can be reduced in length in the lengthwise direction of the needles, which means a smaller size of cam box and needle beds.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A flat knitting machine comprising a pair of needle beds, each having a plurality of needle tricks arranged therein, needles respectively located in the needle tricks, each needle having two butts, front and rear, disposed in longitudinally spaced apart relation thereon and/or on a jack connected to the needle, one or more knitting locks disposed on a cam plate of a cam box on a carriage and adapted to act on the rear butt, each knitting lock including a pair of stitch cams, a pair of raising cams, and a center cam, and a space provided between said pair of raising cams and below the center cam and adapted to permit the passage of the rear butt therethrough, characterized in that there is disposed in said space a loop-receiving raising cam having at least one cam face adapted to act on the back of said rear butt to raise the needle into a loop receiving path; in that a part of the underside of said center cam that faces said space is adapted to serve as a cam face which will act on the front of said rear butt to lower the needle into the loop receiving path; in that there is disposed above the center cam a loop-transfer lowering cam having at least one cam face adapted to act on the front of said rear butt to lower the needle into an operative zone of the stitch cams; in that above the loop-transfer lowering cam there is disposed a retractable loop-transfer raising cam having at least one cam face adapted to act on the back of said front butt to raise the needle into the loop transfer path; and in that either the rear butt or each raising cam is displaceable to an inoperative zone relative to the other so as to permit the rear butt to be guided into an operative zone of said loop-receiving raising cam in said space.

2. A flat knitting machine as set forth in claim 1, wherein said loop-receiving raising cam having a cam face adapted to act on the back of said rear butt to raise the needle to the loop receiving path is such that such cam face is present only on the side facing one direction of movement of the carriage.

3. A flat knitting machine as set forth in claim 1 or 2, wherein said underside part facing said space and adapted to serve as a cam face acting on the front of said rear butt to lower the needle to the loop receiving path is so formed as to face only one direction of movement of the carriage.

4. A flat knitting machine as set forth in claim 1, wherein said loop transfer lowering cam having a cam face acting on the front of said rear butt to lower the needle to the path of stitch cam operation is such that such cam face is present only on the side facing the other direction of movement of the carriage.

5. A flat knitting machine as set forth in claim 1, wherein said loop-transfer raising cam having a cam face acting on the back of said front butt to raise the needle to the loop transfer path is such that such cam face is present only on the side facing the other direction of movement of the carriage.

6. A flat knitting machine as set forth in claim 1, wherein said loop-receiving raising cam having a cam face acting on the back of said rear butt to raise the needle to the loop receiving path is such that there is provided a pair of such cams, one having such cam face fronting one direction of movement of the carriage, the other having such cam face fronting the other direction of movement of the carriage.

7. A flat knitting machine as set forth in claim 1, wherein said loop-receiving raising cam having a cam face acting on the back of said rear butt to raise the needle to the loop receiving path is such that said cam has a pair of such cam faces, one of the pair facing one direction of movement of the carriage and the other facing the other direction of movement of the carriage.

8. A flat knitting machine as set forth in claim 1, 6 or 7, wherein said underside part facing said space and adapted to serve as a cam face acting on the front of said rear butt to lower the needle to the loop receiving path is such that there is provided a pair of such cam faces, one of the pair facing one direction of movement of the carriage and the other facing the other direction of movement of the carriage.

9. A flat knitting machine as set forth in claim 1, wherein said loop-transfer lowering cam having a cam face acting on the front of said rear butt to lower the needle to the operative zone of the stitch cams is such that said cam has a pair of such cam faces, one of the pair facing one direction of movement of the carriage and the other facing the other direction of movement of the carriage.

10. A flat knitting machine as set forth in claim 1, wherein said loop-transfer raising cam having a cam face acting on the back of said front butt to raise the needle to the loop transfer path is such that said cam has a pair of such cam faces, one of the pair facing one direction of movement of the carriage and the other facing the other direction of movement of the carriage.

11. A flat knitting machine as set forth in claim 1, wherein both said front and rear butts are disposed on the needle.

12. A flat knitting machine as set forth in claim 1, wherein said front butt is disposed on the needle and said rear butt is disposed on the jack connected to the needle.

13. A flat knitting machine as set forth in claim 1, wherein both said front and rear butts are disposed on the jack connected to the needle.

14. A flat knitting machine as set forth in claim 13, wherein said rear butt on the jack is retractable so that it is displaceable between its operative and inoperative positions relative to the knitting lock.

15. A flat knitting machine as set forth in claim 1, wherein said raising cams each is retractable so that it is dispoaceable between its operative and inoperative positions.

16. A flat knitting machine as set forth in claim 1, wherein said center cam is retractable so that it is displaceable between its operative and inoperative positions.

17. A flat knitting machine as set forth in claim 1, wherein said loop-receiving raising cam is retractable so that it is displaceable between its operative and inoperative positions.

18. A flat knitting machine as set forth in claim 14, wherein said raising cams each is fixed to the cam plate.

19. A flat knitting machine as set forth in claim 14, wherein said center cam is fixed to the cam plate.

20. A flat knitting machine as set forth in claim 14, wherein said loop-receiving raising cam is fixed to the cam plate.

21. A flat knitting machine as set forth in claim 1, wherein said front butt has its height set so that it is not subject to the action of the knitting lock.

22. A flat knitting machine as set forth in claim 21, wherein the distance $\alpha$ between said front and rear butts is smaller than the height h of the stitch cam along the length of the needle.

23. A flat knitting machine as set forth in claim 21, wherein said needle beds each has a groove of U-shaped cross section provided thereon and along the length thereof to permit passage of said loop-transfer raising cam at its projected position.

24. A flat knitting machine as set forth in claim 1, wherein said knitting lock has a guide cam retractably provided therein between said center cam and said loop-transfer lowering cam located thereabove, said guide cam having a cam face adapted to act on the front of said rear butt to lower the needle to the operative zone of the stitch cams.

* * * * *